US005467113A

United States Patent [19]

Ishinaga et al.

[11] Patent Number: 5,467,113

[45] Date of Patent: Nov. 14, 1995

[54] INK-JET RECORDING HEAD, BOARD FOR SAID HEAD AND INK-JET RECORDING APPARATUS

[75] Inventors: Hiroyuki Ishinaga, Tokyo; Tsuguhiro Fukuda; Toshihiro Mori, both of Yokohama, all of Japan

[73] Assignee: Canon Kabushiki Kaisha, Tokyo, Japan

[21] Appl. No.: 380,330

[22] Filed: Jan. 30, 1995

Related U.S. Application Data

[63] Continuation of Ser. No. 92,928, Jul. 15, 1993, abandoned, which is a continuation of Ser. No. 768,267, Dec. 12, 1991, abandoned.

[30] Foreign Application Priority Data

Feb. 26, 1990 [JP] Japan ..... 2-42527

[51] Int. Cl.[6] ..... B41J 29/38

[52] U.S. Cl. ..... 347/17; 347/19; 347/61; 347/171; 347/177

[58] Field of Search ..... 347/5, 9, 14, 17, 347/19, 20, 56, 61, 171, 177

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,719,472 | 1/1988 | Arakawa | 346/140 R |
| 4,723,129 | 2/1988 | Endo et al. | 346/1.1 |
| 4,740,796 | 4/1988 | Endo et al. | 346/1.1 |
| 4,791,435 | 12/1988 | Smith et al. | 346/140 R |
| 4,899,180 | 2/1990 | Elhatem et al. | 346/140 R |
| 4,910,528 | 3/1990 | Firl et al. | 346/1.1 |
| 4,980,702 | 12/1990 | Kneezel et al. | 346/140 R |
| 5,075,690 | 12/1991 | Kneezel | 346/1.1 |
| 5,175,565 | 12/1992 | Ishinaga et al. | 346/140 R |

FOREIGN PATENT DOCUMENTS

| | | |
|---|---|---|
| 0353925 | 2/1990 | European Pat. Off. . |
| 54-56847 | 5/1979 | Japan . |
| 59-123670 | 7/1984 | Japan . |
| 59-138461 | 8/1984 | Japan . |
| 60-71260 | 4/1985 | Japan . |
| 61-158459 | 7/1986 | Japan . |
| 61-146559 | 7/1986 | Japan . |
| 62-144956 | 6/1987 | Japan . |
| 195056 | 4/1989 | Japan . |

*Primary Examiner*—Sandra L. Brase
*Attorney, Agent, or Firm*—Fitzpatrick, Cella, Harper & Scinto

[57] ABSTRACT

An ink-jet recording head for discharging ink by imparting heat energy to the ink, wherein heaters (8*a*, 8*b*) for warming a board are provided on the board (1) provided with a discharging heater array (6) as a group of discharging warming heaters (5) for generating thermal energy at both sides of the discharging heater array (6) as well as sensors (2*a*, 2*b*) for detecting the temperature of the board are provided. Each of the sensors is disposed at the positions, at which a time required for the influence due to temperature change only when a predetermined ink discharging heater is energized, reaches said positions is substantially equal to a time required for the influence due to temperature variations when each of the warming heaters (8*a*, 8*b*) is energized, reaches said positions. Therefore, the recording head temperature control can be carried out with a high degree of accuracy and at excellent response in a stabilized mode.

23 Claims, 13 Drawing Sheets

INK-JET RECORDING HEAD, BOARD FOR SAID HEAD AND INK-JET RECORDING APPARATUS

This application is a continuation of application Ser. No. 08/092,928 filed Jul. 15, 1993, which is a continuation of application Ser. No. 07/768,267 filed Dec. 12, 1991, both now abandoned.

TECHNICAL FIELD

The present invention relates to a board for an ink-jet recording head or more particularly to a board for an ink-jet recording head of the type in which an electro-thermal energy converting element or elements are used as energy generating means for ink discharging, a recording head fabricated by using the board and a recording apparatus equipped with the recording head.

BACKGROUND ART

The ink-jet recording head of the type described above has been attracting special attention because discharging orifices for discharging recording ink as droplets for example can be arrayed at an extremely high density so that the recording with a high degree of resolution can be obtained; because it is rather simple to fabricate the whole recording head which is compact in size; because the IC technology which has made remarkable advance and are highly reliable in the fabrication of the semiconductor devices and microscopic components can be fully utilized in the fabrication of the recording heads so that a long array of discharging orifices and a flat array (two-dimensioned) of discharging orifices can be easily fabricated, whereby many discharging orifices can be assembled into a recording head at a high degree of density; and because the fabrication of the recording heads, therefore, can be made with a high degree of yield and at less costs.

FIG. 1 illustrates the construction of one of the recording heads of the type described above. A heater board 27 which comprises electro-thermal converting elements or heaters for ink discharging (to be referred to as "discharging heaters" hereinafter) 29 and wires 28 made of aluminum for supplying the electric power to the electro-thermal converting elements 29 is fabricated on the surface of a silicon substrate by a thin film forming process. A top plate 30 which has a plurality of partition walls for defining a plurality of liquid paths 25 is bonded to the heater board 27, whereby an ink-jet recording head can be fabricated.

A recording liquid (ink) is supplied through a supply inlet formed on the top plate 30 into a common liquid chamber 23 and then supplied to each liquid path 25. When the heater 29 is energized, the ink filled in each of the liquid paths 29 generates bubbles so that an ink droplet is discharged from a discharging orifice 26.

However, because of the solidification of the ink, the intrusion of air bubbles into the liquid paths due to the vibration of the recording head or the operation of the recording head at high temperatures and other adverse causes, the recording head used in the ink-jet recording system frequently becomes unable to discharge the liquid droplets. Especially in the case of the system utilizing discharging heaters, the thermal energy is used to discharge the liquid droplets so that the temperature of the recording head tends to rise. In the normal ink discharging condition, almost all the thermal energy is absorbed by the ink droplets to be discharged so that the temperature of the recording head rises to 50°–60° C. at the most, but when the ink discharging operation is interrupted due to the causes described above and the like, the thermal energy generated by the discharging heaters is stored within the head so that its temperature rises higher than 150° C. with the result of the breakdown of the recording head. Especially it must be noted here that since the top plate 30 is in general fabricated by molding a suitable resin so that the top plate 30 starts its deformation at a temperature of the order of 120° C.

Furthermore, even when the interruption of the liquid or ink droplet discharge does not occur because of the reasons mentioned above, thermal energy is accumulated at one or more portions of the discharging heaters due to a long recording period, recording conditions and the like so that the temperature of the recording head sometimes rises in excess of its normal operation temperature.

When the temperature variations become greater in the recording head, the variations in quality of the recorded image formed by the landing of the ink droplets discharged from the recording head whose temperature vary, occur.

In the conventional recording heads, the heater board 27 is equipped with a plurality of heating elements or discharging heaters so that in order to dissipate heat, for instance an aluminum plate is securely bonded to the heater board 27. The heat dissipating plate are equipped with one or more temperature sensors such as thermistors or the like in the vicinity of the heater board 27 so that in response to the outputs of the temperature sensors the temperature of the recording head is controllable. But the difference in temperature exists between the heater board 27 and especially the portions in the vicinity of the discharging heaters 29 and the positions at which the temperature sensors are disposed, and furthermore the transmission of heat through the aluminum plate of course takes time with the result of the time delay of heat transmission so that the correct and quick countermeasure cannot be carried out. As a result, in the case of recording mode, the variations in concentration or tone of the recorded images occur. In addition, the breakdown of the recording head due to an abnormal temperature rise during the interruption of the ink discharge.

It must be noted here especially that in the ink-jet recording systems, the temperature of ink is one of the very important factors to be taken into consideration in view of attaining a high grade recording. The reason is that the physical properties of a recording ink such as its surface tension, a degree of viscosity and the like vary in response to its temperature and as a result the quantity of discharged ink and the supply rate of the ink vary. In view of the above, it is extremely important that the temperature of the ink be maintained within a predetermined range. Therefore, means for maintaining the temperature of the recording liquid within a predetermined range, is required in addition to means used for preventing the abnormal temperature rise, so that some recording systems are equipped with suitable heating means, that is, one or more heaters for warming the recording head at the predetermined range (to be referred to as "warming heaters" hereinafter).

So far such the heater or heaters are disposed on a suitable member or members as like the temperature sensors, but the warming heater or heaters the recording head through the member or members so that the variations in time of heat transmission result and therefore a satisfactory degree of energy efficiency cannot be attained.

Furthermore, in the conventional recording systems, the temperature sensors and the heaters must be disposed independently so that their costs and the costs for assembling them become expensive and consequently the recording heads themselves also become expensive.

A further problem is that it is next to impossible to control the temperature gradient within the heater board once it happens.

It follows therefore that, as disclosed in Laid-open European Patent Application Publication No. 353925/1990, the temperature sensors and warming heaters for maintaining the temperature of the heater board within a predetermined temperature range be disposed integrally over the heater board. According to this construction, the temperature sensors and the heaters are disposed in the vicinity of the discharging heaters for so that the temperature control with a high degree of accuracy and response is expected to be carried out.

However, according to this teaching, the positional relationships between the discharging heaters, the warming heaters for warming the recording head and the temperature sensors have not been so far taken into consideration so that no countermeasure against the temperature distribution which vary rapidly within the heater board can be taken. As a result, it is difficult to control the ink discharging characteristics at a high degree of accuracy in practice. More specifically, the temperatures of the discharging heaters which mostly influence the recording liquid discharging characteristics are dependent upon the heat from the warming heaters which are statically controlled and the temperature changes caused by the discharging heaters themselves whose heat generation dynamically changes. That is, the temperatures of the discharging heaters are dependent upon the complicated combinations of the thermal energy generated by both the discharging and warming heaters. As a result, the stabilized recording liquid discharging characteristics cannot be assured only by the control for maintaining the temperature within a predetermined range in response to the outputs from the temperature sensors whose positions are not taken into consideration in design and construction.

DISCLOSURE OF THE INVENTION

In view of the above, the primary object of the present invention is to carry out the temperature control at a high degree of accuracy, response and stability by suitably determining the positions of temperature sensors.

Therefore, in a first aspect of the present invention, an ink-jet recording head having, positioned on the same substrate, ink discharging orifices, a plurality of heat generating elements for generating thermal energy used for discharging ink from the ink discharging orifices, a temperature sensor element for detecting a temperature of the substrate and a heating element for applying heat to the substrate, is characterized in that the temperature sensor element is disposed at a position where a time required for the influence due to a temperature change, when only a predetermined heat generating element is energized, to become exertive on the position is substantially equal to a time required for the influence due to a temperature change, when only the heating element is energized, to become exertive on the position.

In a second aspect of the present invention, an ink-jet recording head having, positioned on the same substrate, ink discharging orifices, a plurality of heat generating elements for generating thermal energy used for discharging ink from the orifices, temperature sensor element for detecting a temperature of the substrate and a heating element for applying heat to the substrate, is characterized in that the temperature sensor element is disposed at a position which is spaced apart from a predetermined heat generating element and the heating element by the substantially same distance.

In a third aspect of the present invention, a board for an ink-jet recording head having, positioned on the same substrate, a plurality of heat generating elements for generating thermal energy used for discharging ink from ink discharging orifices, temperature sensor element for detecting a temperature of the substrate and heating element for applying heat to the substrate, is characterized in that the temperature sensor element is disposed at the position where a time required for the influence due to a temperature change, when only a predetermined heat generating element is energized, to become exertive on the position is substantially equal to a time required for the influence due to a temperature change, when only the heating elements is energized, to become exertive on the position.

In a fourth aspect of the present invention, an ink-jet recording apparatus with an ink-jet recording head, the head having, disposed on the same substrate, ink discharging orifices, a plurality of heat generating elements for generating thermal energy used for discharging ink from the ink discharging orifices, temperature sensor element for detecting a temperature of the substrate and a heating element for applying heat to the substrate, is characterized in that the temperature sensor element is disposed at a position where a time required for the influence due to a temperature change, when only a predetermined heat generating element of the recording head is energized to become exertive on the position is substantially equal to a time required for the influence due to a temperature change, when only the heating element is energized, to become exertive on the position.

Here, The position at which the temperature sensor element is disposed may be spaced apart from the predetermined heat generating element and the heating element by the substantially same distance.

The predetermined heat generating element may be selected from an intermediate temperature portion of the plurality of generating elements.

The predetermined heat generating element may be selected from an high temperature portion of the plurality of heat generating elements.

The ink-jet recording head, the board for the head or the ink-jet recording apparatus, may have a plurality of the temperature sensor elements equal in number to a plurality of the heating elements, or have one or more temperature sensor elements whose number is less than a plurality of the heating elements.

The temperature sensor element may be a diode sensor.

The temperature sensor element may be disposed within a circle drawn at the position as a center and with a radius of $P \times N/4$, where N represents the number of heat generating elements in the high-temperature portion of the plurality of heat generating elements; and P denotes a pitch at in the array of the plurality of heat generating elements.

The predetermined heat generating element may be one of the plurality of heat generating elements which exhibits substantially an average temperature of the plurality of heat generating elements.

Furthermore, a copying apparatus in accordance with the present invention is equipped with the ink-jet recording apparatus as an information output means.

Similarly, a facsimile apparatus in accordance with the present invention is equipped with the ink-jet recording apparatus as an information output means.

A word processor in accordance with the present invention is also equipped with the ink-jet recording apparatus as an information output means.

Also an optical disk apparatus in accordance with the present invention is equipped with the ink-jet recording apparatus as an information output means.

Furthermore, a work station in accordance with the present invention is equipped with the ink-jet recording apparatus as an information output means.

A computer in accordance with the present invention is also equipped with the ink-jet recording apparatus as an information output means.

Similarly, a portable printer in accordance with the present invention is equipped with the ink-jet recording apparatus as an information output means.

According to the present invention, temperature sensor element is suitably disposed at an optimum position with respect to the predetermined heat generating element and the heating element so that the difference in time between a time when the temperature change occurs on the one hand and a time when such temperature change is detected can be eliminated or is substantially negligible so that no control variations result.

BEST MODES FOR CARRYING OUT THE INVENTION

Now the present invention will become more apparent from the following description of the preferred embodiments thereof taken in conjunction with the accompanying drawings.

Figure 1:
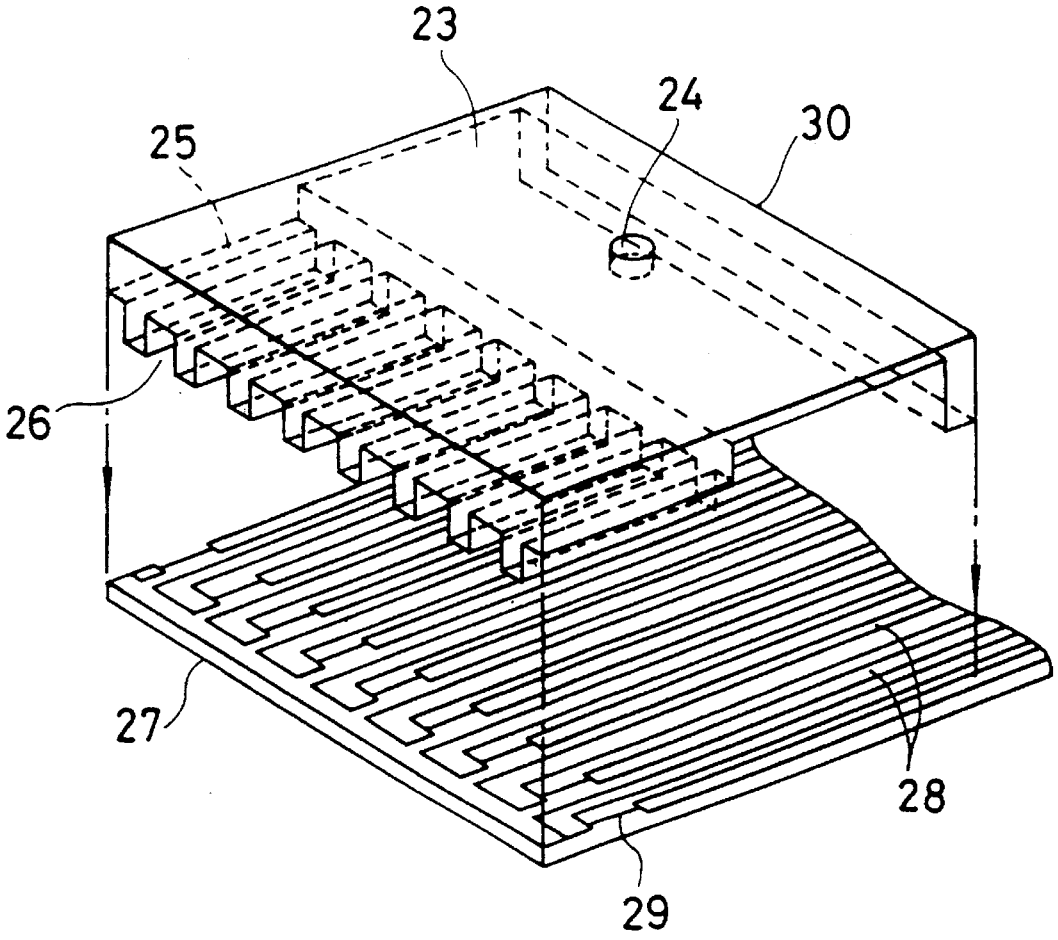
FIG. 1 (PRIOR ART)
FIG. 1 is a schematic perspective view illustrating the general construction of one of the conventional ink-jet recording heads.
Figure 2:
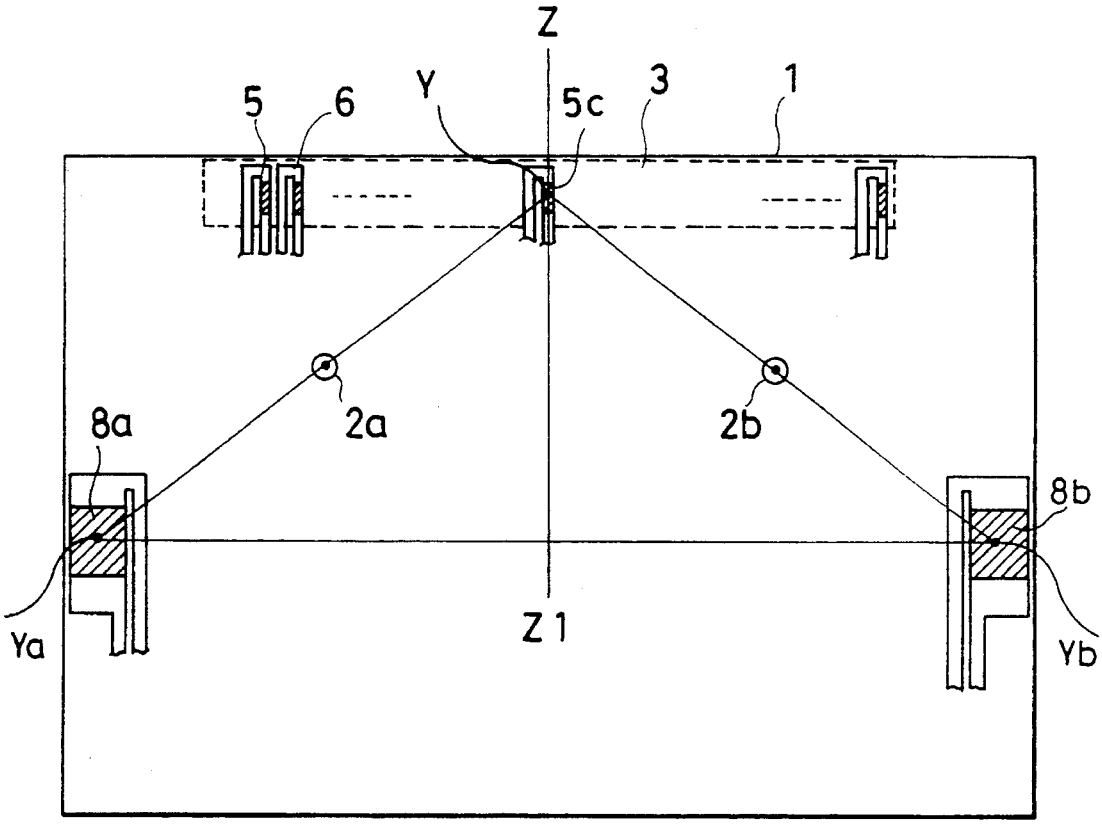
FIG. 2 is a schematic top view of a first embodiment of the present invention illustrating the positions at which temperature sensors are disposed on a heater board.

FIG. 2 is a top view of a first embodiment illustrating an ink-jet recording head board or heater board in accordance with the present invention which can be applied to the recording head described above with reference to FIG. 1 in practice.

A heater board 1 comprises a substrate made of the same material (for instance, Si) and uniform in thickness and a discharging heater array 3 which has a group of discharging heaters and is formed on the substrate together with the discharging heaters 5 and their wires 6. Especially, reference numeral 5*c* represents a discharging heater disposed at the center, or most closely adjacent thereto, of the discharging heater array 3.

Warming heaters 8*a* and 8*b* maintain the temperature of a head within a predetermined range and are disposed symmetrically about the center axis Z–Z1 of the heater board coaxial with the discharging heater 5*c*.

Reference numerals 2*a* and 2*b* represent temperature sensors, respectively. In the normal recording condition, the temperature at the center point of the heater is substantially an average temperature within the discharging heaters and the warming heaters so that in the first embodiment, the centers of the heaters 5*c*, 8*a* and 8*b* are defined as reference points, respectively, and the temperature sensors 2*a* and 2*b* are disposed at the midpoints, respectively, of the lines Y–Ya and Y–Yb joining the centers of the discharging heater 5*c* and the warming heater 8*a* and between the centers of the discharging heater 5*c* and the warming heater 8*b*.

Figure 3A:
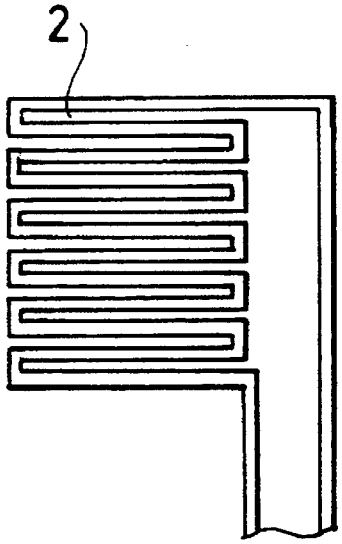
FIG. 3A and FIG. 3B are schematic top views illustrating two examples of warming heaters, on an enlarged scale, disposed on the heater board.
Figure 3B:
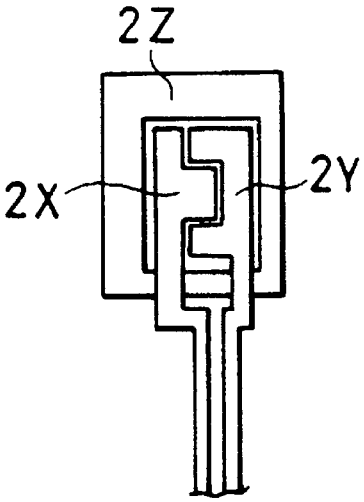

FIGS. 3A and 3B illustrate, on an enlarged scale, two examples of the temperature sensors 2*a* and 2*b*. In the first embodiment, like other components, the temperature sensors 2*a* and 2*b* are formed by a suitable thin film forming process used in the fabrication of semiconductor devices, so that each of them has a high degree of accuracy. The temperature sensor shown in FIG. 3A can be formed from a material such as aluminum, titanium, tantalum, tantalum pentaoxide, niobium and the like which are materials for forming other components and whose electric conductivity varies in response to the temperature. For instance, aluminum is a material used to form electrodes; titanium is a material which can be interposed between a heat generating resistance layer and an electrode which are assembled to form an electro-thermal converting element in order to increase the bonding strength between them; and tantalum is a material which can cover a protective layer on the heat generating resistance layer in order to increase the cavitation-proof capability of the protective layer. Furthermore, in the thin film forming process, in order to minimize the variations of the width of lines, their width is selected to be greater and in order to minimize the adverse influence of electric wires and the like, they are patterned in a zig-zag form, thereby increasing the resistance.

FIG. 3B illustrates another example of the temperature sensor 2 which is a diode fabricated by a thin film forming process. Reference numerals 2X and 2Y represent an anode electrode and a cathode electrode, respectively. In order to prevent the crosstalk between the diode and other elements, the diode is surrounded by an isolation zone 2Z.

Like these temperature sensors, the warming heaters 8*a* and 8*b* can be fabricated by using the same material, for instance $HfB_2$, of the heat generating resistance layer, but it is to be understood that they can also formed by using one of the materials such as aluminum, tantalum, titanium and the like which are used to fabricate the heater board.

Figure 4A:
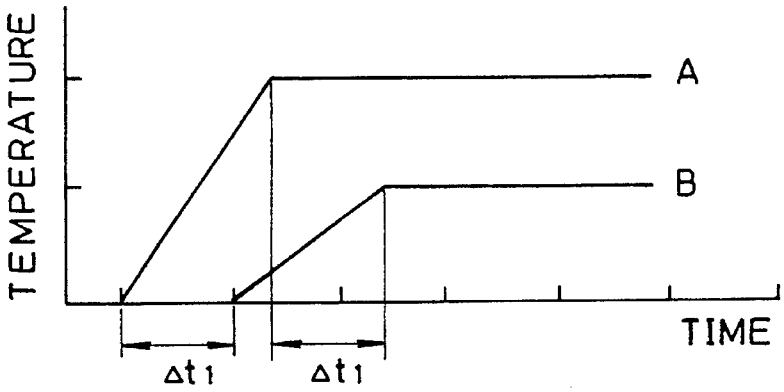
FIGS. 4A, 4B and 4C are diagrams used to explain the differences in detection time by the temperature sensors depending upon the positions at which they are disposed, respectively.
Figure 4B:
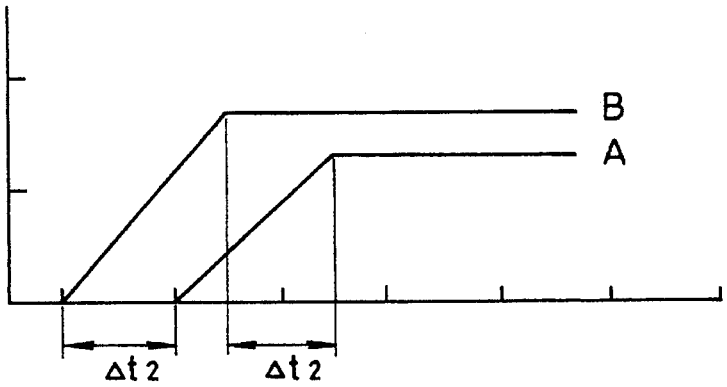
Figure 4C:
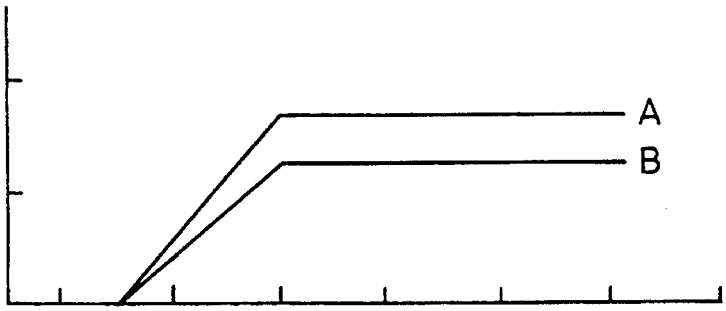

FIGS. 4A, 4B and 4C schematically illustrate time periods required for the transmission of heat to the position of the temperature sensors on the lines joining the discharging heater array 3 and the warming heaters 8*a* and 8*b*. FIG. 4A illustrates a change with time of temperature (A) by the heat which is transmitted from the warming heater 8*a* or 8*b* to the temperature sensor, and a change with time of temperature (B) by the heat which is transmitted from the discharging heater to the temperature sensor 8*a* or 8*b*, when the temperature sensors 2*a* and 2*b* are disposed in the vicinity of the warming heaters 8*a* and 8*b*, respectively. In like manner, FIG. 4B illustrates temperature changes (A) and (B) with time, when the temperature sensors are disposed in the vicinity of the discharging heater array 3, and FIG. 4C illustrates temperature changes (A) and (B) with time when the sensors are disposed at the midpoints of the lines joining the discharging heater array 3 and the warming heaters 8*a* and 8*b*.

As is apparent from FIGS. 4A, 4B and 4C, in FIG. 4A the temperature sensors are disposed in the vicinity of the warming heaters 8*a* and 8*b*, respectively, so that they detect the heat quickly and then detect, after a time delay of $\Delta t_1$, the heat transmitted from the discharging heater array which is generated at the same time when the heat is generated by the warming heaters. On the other hand, in the case of FIG. 4B, the temperature sensors are disposed in the vicinity of the discharging heater array 3 so that they first detect the heat transmitted from the discharging heater array 3 and then detect, after a time delay of $\Delta t_2$, the heat transmitted from the warming heaters 8*a* and 8*b* which is generated at the same time when the heat is generated by the discharging heater array 3.

In order to control the temperature of the discharging heater array with a high degree of accuracy, the temperature change due to the heat from the discharging heater array and also the temperature change due to the heat from the warming heaters must be detected as soon as possible. But in the cases of FIGS. 4A and 4B, the difference between the time when the temperature sensors detect the heat from the discharging heater array 3 and the time when they detect the heat from the warming heaters 8*a* and 8*b* becomes greater so that the satisfactory temperature control is difficult. On the other hand, in the case of FIG. 4C the temperature sensors are disposed at the positions where the heat from the discharging heater array 3 and the heat from the warming heaters 8*a* and 8*b* reach substantially at the same time so that the above-mentioned time delay is eliminated and consequently it becomes possible to carry out the satisfactory detection of the temperature of the head.

In the first embodiment, more than tens to hundreds heaters like the discharging heaters 5 are arrayed on the heater board 1 as needs demand. Two warming heaters are disposed at the right and left sides, respectively, of the heater board 1. These heaters rise to considerably high temperatures, respectively, when they are energized. The temperature of the warming heater rises as high as about 90° C. and the temperature of the discharging heater rises as high as about 200° C. when the discharge of the ink is intercepted. Furthermore, the temperature gradient is very steep and the time constant is small.

On the other hand, in the case of the ink-jet recording system, in order to improve the ink discharge efficiency, it is effective that the recording is carried out in the condition that the temperature of the heater board 1 or the discharging heater array 3 is relatively high. The reason is that when the recording liquid is ejected at high temperature, the satisfactory ink discharge quantity and velocity is assured even when the power consumption is small.

Figure 5:
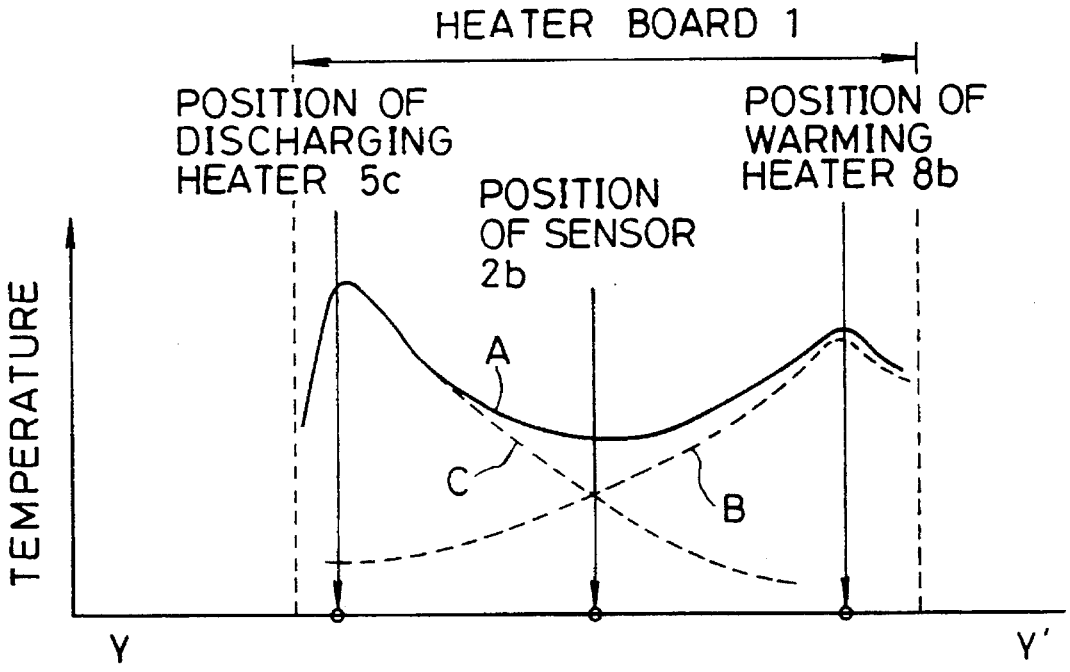
FIG. 5 is a diagram used to explain the temperature distribution over the surface of the heater board.

However, as shown in FIG. 5, when the positions of the temperature sensors are deviated on the side of the discharging heater array or the warming heaters, in addition to the problem of the heat transmission time difference described above, there arises the following problem. It is considered that it becomes difficult to maintain the temperature of the discharging heater array within a suitable temperature range due to the greater influence of the temperature gradient c defined when only the discharging heater 5 is energized or of the temperature gradient B defined when only the warming heaters 8*a* and 8*b* are energized.

More specifically, it is extremely preferable that the recording is carried out while the portion of the discharging heater array or thereabout are maintained within a suitable temperature range. However, when the temperature sensors are disposed in the vicinity of the discharging heater array 3, they are greatly influenced from the side of the discharging heater array. As a result, in the case that the temperature of a portion of the discharging heater array becomes higher than a suitable temperature range within which the discharging heater array must be maintained, the temperature sensors detect such too high temperature, there is a fear that a suitable warming mode cannot be maintained. On the other hand, in the case that when the temperature sensors are disposed closer to the warming heaters, they are greatly influenced by the warming heaters so that there is a fear that the temperature of the discharging heater array cannot be maintained in a stabilized state.

Meanwhile, in the discharging heater array, the ink discharging duty of each of discharging heaters varies depending upon an image to be recorded so that local temperature differences result. When such local temperature differences are great, the concentration or density difference of a recorded pattern result, thereby causing the degradation of the recorded pattern.

The experiments conducted by the inventors confirm that in the normal recording mode the discharging heater 5*c* at the center or thereabout of the discharging heater array 3 substantially indicates the average temperature of the whole discharging heater array 3. According the first embodiment, therefore, the temperature of the discharging heater array 3 is defined by the temperature of the discharging heater 5*c*. That is, when the temperature of the discharging heater 5*c* is selected as a reference temperature, in the normal recording mode, it is possible to control with less errors the temperatures of the discharging heater groups of the discharging heater array 3.

In view of the above, in the first embodiment of the present invention, as shown in FIG. 2, the temperature sensors 2*a* and 2*b* are disposed at the midpoints, respectively, of the lines joining the discharging heater 5*c* on the one hand and the warming heaters 8*a* and 8*b* on the other hand. As described above, the substrate of the heater board 1 is substantially uniform in thickness so that a time required for heat from the warming heaters 8*a* or 8*b* to reach the corresponding midpoint, when only the warming heater 8*a* or 8*b* is energized, is equal to a time required for heat from the discharging heater 5*c* is energized. In other words, a time which the influence of the temperature change at each of the heaters requires to reach the corresponding midpoint is equal.

In FIG. 5, a curve A represent the temperature distribution along the axis Y–Yb (or Y–Ya) joining between the discharging heater 5*c* and the warming heater (or 8*a*). In the first embodiment, the temperature sensor 2*b* (or 2*a*) is disposed at the midpoint of the axis joining the portion of the discharging heater 5*c* at which the average temperature of the discharging heater array 3 is detected on the and the warming heater 8*b* (or 8*a*) so that a time required for the heat from the discharging heater 5*c* to reach the sensor is equal to a time required for the heat from the warming heater 8*b* (or 8*a*) to reach the sensor. As a result, no time delay between the time when the heat from the discharging heater 5*c* reaches the sensor and the time when the heat from the warming heater 8*b* (or 8*a*) is occur so that the discharging heater array 3 can be maintained at a desired stabilized temperature without the fluctuation of the control of the temperature characteristics.

More specifically, the positional relationship between each of the temperature sensors and each of the warming heaters is suitably determined so that it becomes possible to carry out the open loop control for the temperature change of the discharging heaters, and to carry out the feedback control of the warming heaters for warming the heater board. As a consequence, it becomes possible to control the ink discharging characteristics to be constant. It follows therefore that the problems that the recorded pattern or the like becomes too thin and the variations in tone of the recorded pattern or the like result can be made substantially negligible or almost eliminated.

In the first embodiment, it has been described that the temperature of the discharging heater 5*c* disposed at the center or in the vicinity thereof of the discharging heater array 3 represents the average temperature of the array 3 and the temperature sensors 2*a* and 2*b* are disposed at the midpoints, respectively, of the lines joining the center of the discharging heater 5*c* on the on hand and the warming heater 8*a* and 8*b* on the other hand. However, in the case that a recording time is long, or a pattern is recorded with a high degree of resolution or a broad head with a large number of discharging orifices is used, the position of each of the temperature sensors may deviated from the above-mentioned lines joining the centers of the heaters.

Figure 6:
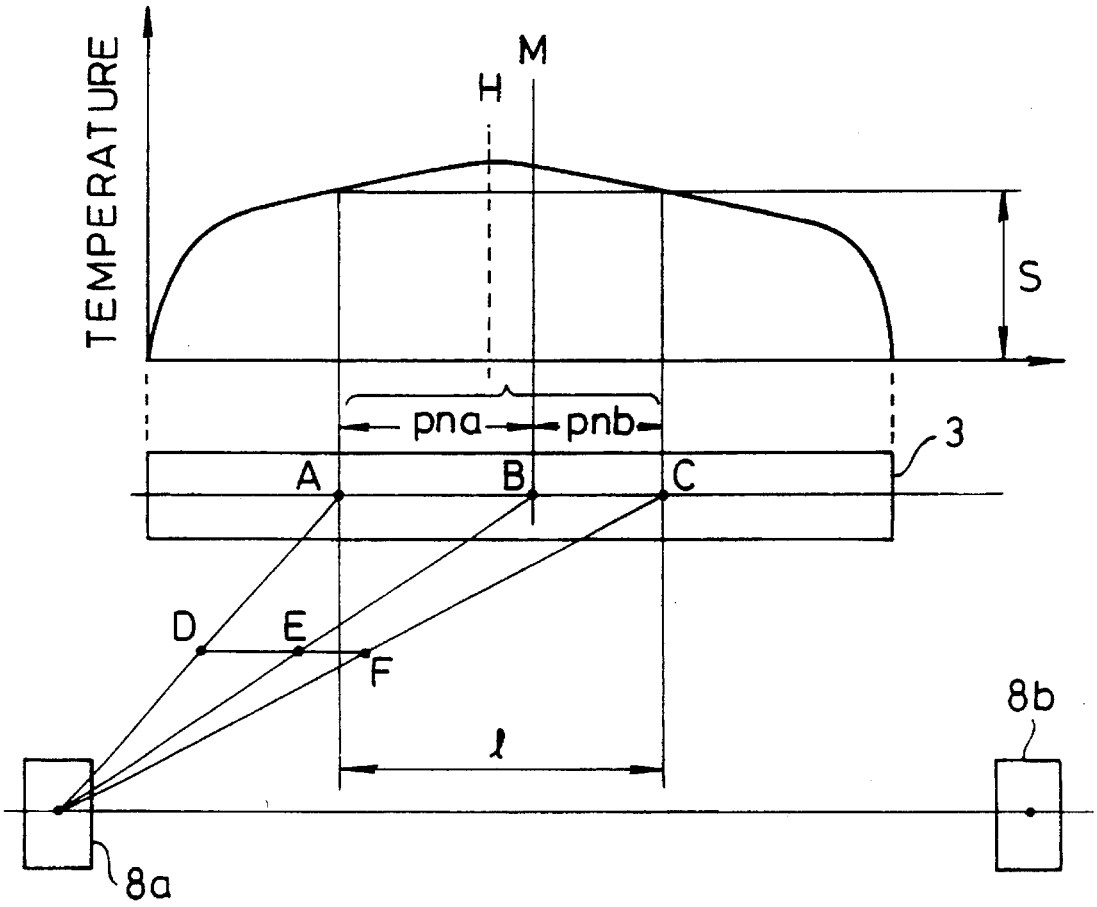
FIG. 6 is an explanatory diagram of another embodiment of the present invention particularly illustrating the positions at which the temperature sensors are disposed.

FIG. 6 illustrates another embodiment of the present invention in which the sensors are deviated from such the lines.

In FIG. 6, the arrangement of the discharging heater array 3, the warming heaters 8*a* and 8*b*, and the temperature sensors on the heater board is schematically illustrated at the lower portion of FIG. 6 and the temperature distribution within the discharging heater array when the warming heaters are deenergized is also schematically illustrated in the upper half portion of FIG. 6. Dependent upon the recording mode or the length of the discharging heater array 3, high and low temperature portions are occurred in the array 3.

Especially in the case of the recording head which is used at a high frequency, the temperature of one portion of the discharging heater array 3 rises high so that there is a fear that the degradation of the recording quality and the deterioration of the discharging heaters 5. In this case, a temperature sensor is disposed in such a way that especially the temperature at the high-temperature portion of the discharging heater array 3 can be easily detected, thereby controlling the temperature within the heater board. In this case, it is preferable that the high-temperature portion be defined at a portion at which the temperature is within the upper 15% range (S=85%) between the highest and lowest temperature. The second embodiment illustrates that the center of the discharging heater array 3 does not coincide with the highest temperature position. In this case, the length l of the high-temperature portion is expressed by $$l=P(n_a+n_b)$$

Where n is the number of the ink discharging orifices at the high-temperature portion; $n_a$ is the number of the discharging orifices at the high-temperature portion on the left side from the center B of the discharging heater array 3; $n_b$ is the number of the discharging orifices at the high-temperature portion on the right side of the center B; and P is the pitch of the discharging heaters.

Now it is preferable that each of the temperature sensors is disposed in the vicinity of the midpoint (½ of the distance) of the line joining the reference points of the discharging heater array 3 and each of the warming heaters, but when the reference points of the discharging heater array 3 are defined at the left end A of the high temperature portion, the center B of the discharging heater array 3 and the right end C of the high temperature portion, the midpoints of the lines joining the reference points and the warming heater (for instance 8*a*) are D, E and F, respectively, as shown in FIG. 6.

In this case, it is assumed that the line sections AC and DF be substantially parallel for the sake of the simple explanation. Then $$\text{Line Section } DE=\tfrac{1}{2}P\ n_a$$

and $$\text{Line Section } EF=\tfrac{1}{2}P\ n_b$$

It follows therefore that when the positions of the temperature sensors at the high temperature portion are taken into consideration, the satisfactory temperature detection can be carried out at the high temperature portion by disposing the temperature sensor at the position spaced apart from the point E in opposing relationship with the center point B of the discharging heater array 3 by the distance ½P $n_a$ or ½P $n_b$, respectively, on the left or right side of the point E.

So far in the second embodiment, the arrangement of the temperature sensors in the longitudinal direction (that is, the direction in which the discharging heaters are arrayed) of the discharging heater array 3 has been considered, but when the shapes of the discharging heater array 3 and the warming heaters 8*a* and 8*b*, and thermal or temperature distribution in the direction different from the longitudinal direction of the array 3 are taken into consideration, the portion in which the temperature sensors are disposed is extended in the direction different from the longitudinal direction of the discharging heater array 3. However, the result of the experiments shows that such extension is less than the extension in the longitudinal direction of the discharging heater array 3. Thus it is preferable that the temperature sensor is disposed within a circle with the radius of at least ½P $n_b$ or more preferably ½ P $n_a$ and the point E as the center.

Moreover, when the highest temperature position of the discharging heater array 3 coincides with the center thereof the temperature distributions are substantially symmetrical about the center of the array 3, it suffices to dispose the temperature sensor within a circle with the point E as the center and with the radius of ½P $n_a$ (=½P $n_b$).

So far the arrangement of the temperature sensors has been considered by taking the high-temperature portion of the discharging heater array 3, but in the case that a recording is carried out with a high degree of resolution or in the case that the difference between the highest and lowest temperature within the discharging heater array 3 is large, such temperature difference must be minimized as less as possible in order to prevent unevenness or shading of a recorded image. Thus it is preferable that the temperature sensor be disposed at a reference position within a portion in which the high and low temperature portions of the discharging heater array 3 are reflected.

Figure 7:
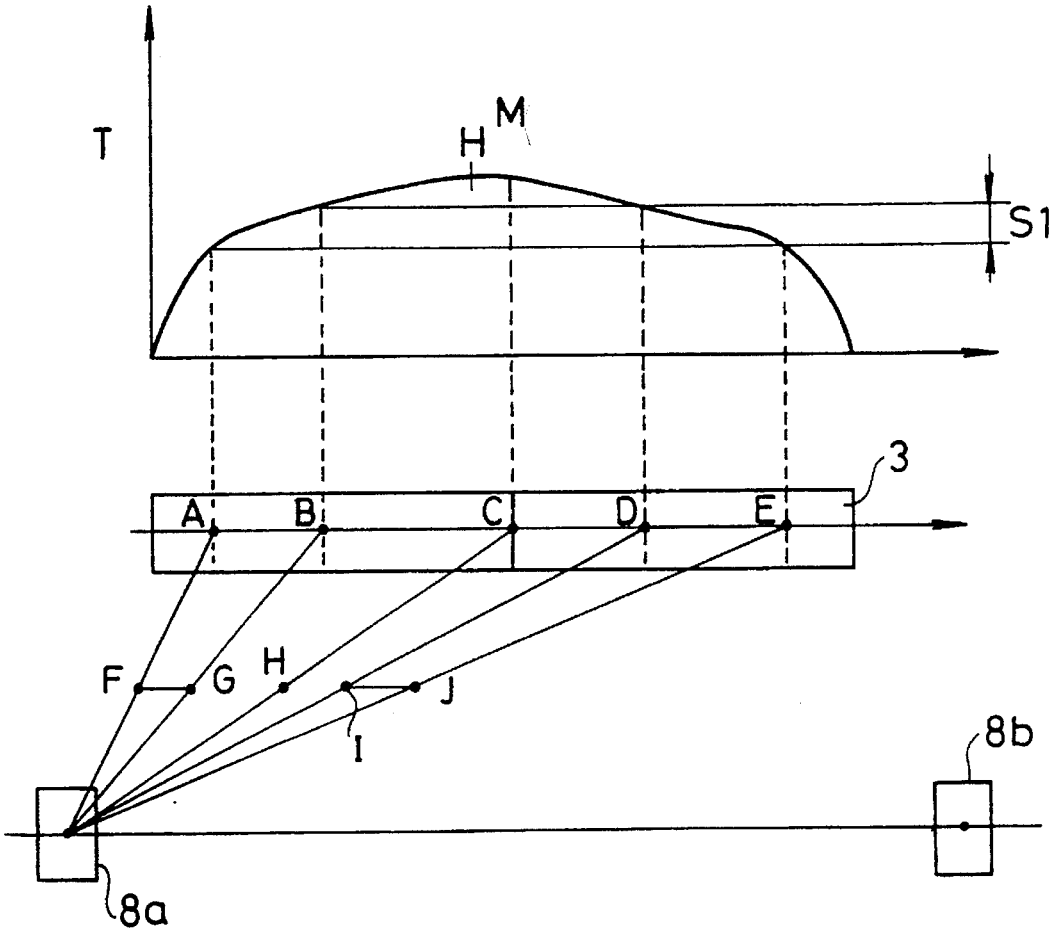
FIG. 7 is an explanatory diagram of a further embodiment of the present invention particularly illustrating the positions at which temperature sensors are disposed.

FIG. 7 illustrates an arrangement of a temperature sensor in the manner described above. In this or third embodiment, the reference position for reflecting the high and low temperature portions is not defined at the portion in which the large changing in temperature occurs, but is defined by taking the intermediate temperature portion S1 at which the temperature is between 85–55% of the temperature difference between the highest and lowest temperatures into consideration. In FIG. 7, the reference position is defined in the portion defined by the lines AB and DE.

When the number of the ink discharging orifices between points A and B is represented by $n_a$; the number of the ink discharging orifices between points D and E, by $n_b$; and the pitch, by P, the lengths of the portions AE and DE in which the reference point may be defined become $Pn_a$ and $Pn_b$ respectively.

Therefore, following the above-described arithmetic calculation, the length FG or IJ for disposing the temperature sensor in the longitudinal direction of the discharging heater array 3 become ½ P $n_a$ or ½P $n_b$, respectively. In the third embodiment, the thermal or temperature distribution in the direction different from the longitudinal direction of the discharging heater array 3 is taken into consideration so that it suffices to dispose the temperature sensor within a circle with the radius of ¼P $n_a$ and the midpoint of the line FG as the center or a circle with the radius ¼P $n_b$ and the midpoint of the line IJ as the center.

In the embodiments described above, the method for determining the position of the left temperature sensor has been explained as an example, but it is quite apparent to those skilled in the art that the same method can be used to determine the position of the right temperature sensor. Furthermore, so far the arrangement of two temperature sensors has been described, but when the temperature control is carried out especially with reference to one portion within the discharging heater array, only temperature sensor can be used.

In the case of the arrangement of one or more temperature sensors, the construction, type, shape, size, characteristics and the like of the temperature sensors, the warming heaters and the discharging heaters and the control characteristics may be taken into consideration. Furthermore, it is not necessary that the center of each temperature sensor is coincident with the midpoint explained above.

When the position of the temperature sensor is selected in such a way that the time required for the influence of the temperature change at the discharging heater to reach the position is equal to the time required for the influence of the temperature change at the warming heater to reach the position, or in such way that the difference between the time when the influence of the temperature change at the discharging heater reaches the position on one hand and the time when the influence of the temperature change at the warming heater is within a tolerable range from the standpoint of the temperature control, the temperature sensor may be disposed not only at such midpoint but also another position which is spaced apart from the discharging and warming heaters by the substantially same distance; that is, a position on a perpendicular bisector, or a position in the vicinity thereof, of a line joining the discharging and warming heaters. Furthermore, for example, when the substrate of the heater board 1 is not uniform in thickness so that the influences of the temperature changes at the discharging and warming heaters do not reach at the same time the position spaced apart from the discharging and warming heaters by the same distance, a suitable position which satisfies the above-mentioned condition can be selected. In addition, when the point at which the average temperature of the discharging heater array 3 does not coincide with the center thereof, the discharging heater at the above-mentioned point can be selected as one reference heater.

In the above embodiments, the sensor 2 may be transistors if the transistors can be formed simultaneous with the thin film processing of the heater board and it is not needed to form them simultaneous with the other devices.

It is of course possible to select a suitable number of the heaters and their positions on the heater board and it is apparent, therefore, to define the arrangement of the temperature sensors.

Next an example of the heater board upon which the temperature sensors are arranged according to one of various manners described above.

Figure 8:
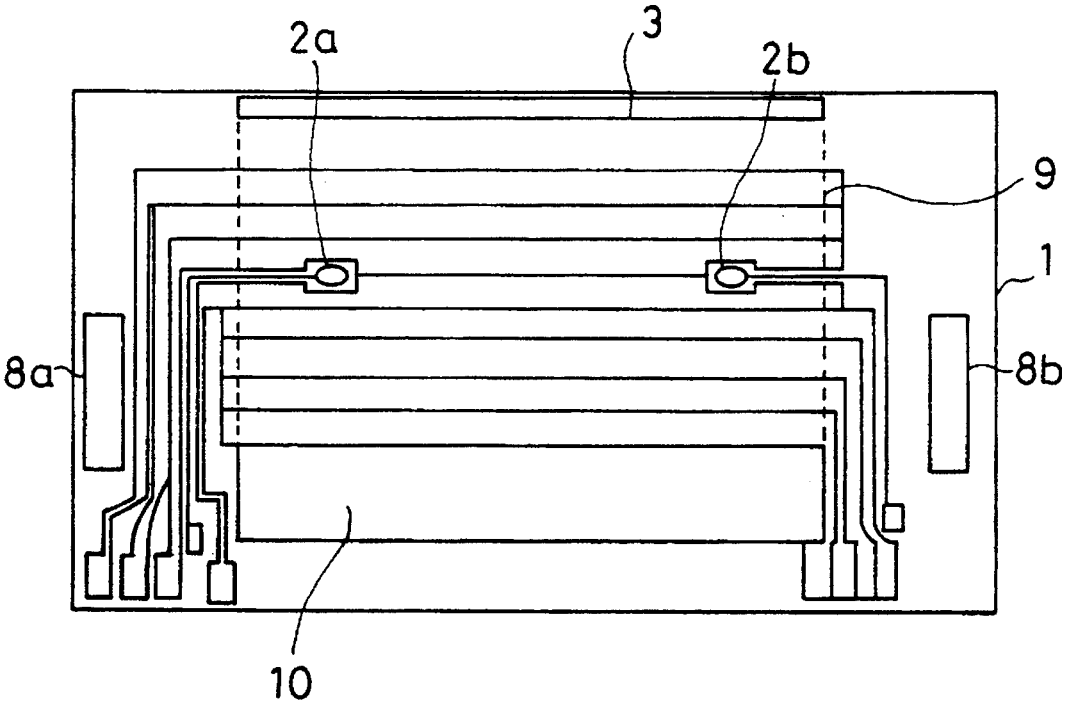
FIG. 8 is a schematic top view illustrating the arrangement of temperature sensors on the heater board.

FIG. 8 schematically illustrates an electric circuit pattern defined on the board for the recording-head (the heater board) in accordance with the present invention. In this figure, each of the temperature sensors **2*a* and 2*b* is disposed at the position which is equally spaced apart from a suitable discharging heater (for instance, the discharging heater 5*c*) and each of the warming heaters 8*a* and 8*b* in terms of the heat transmission time described above, or at the position at which the temperature control of the discharging heaters can be satisfactorily controlled. In the case of a conventional heater board, laterally extended wires as upper circuits of Al disposed on lower circuits of Al (not shown) with an insulating layer interposed therebetween. In this embodiment, the temperature sensors 2*a* and 2*b* described in detail with reference to FIGS. 3A or 3B are formed by the same fabrication step in such a way that the temperature sensors 2*a* and 2*b* do not interfere with the upper laterally extended circuit wires 9 of Al with result that they are disposed at the desired positions, respectively. Furthermore, according to the present invention, the temperature sensors 2*a* and 2*b*** can be disposed at their desired positions, respectively, without forming an insulating layer over the laterally extended circuit wires as a result, it becomes possible to detect the temperature of the heater board with a higher degree of accuracy.

Referring back to FIG. 8, reference numeral represents a driving unit which has diodes or the like for driving the discharging heaters 5. The driving unit 10 and the wires 6 for the discharging heaters are connected to a matrix circuit consisting of the upper wires 9 and the lower wires.

Figure 9:
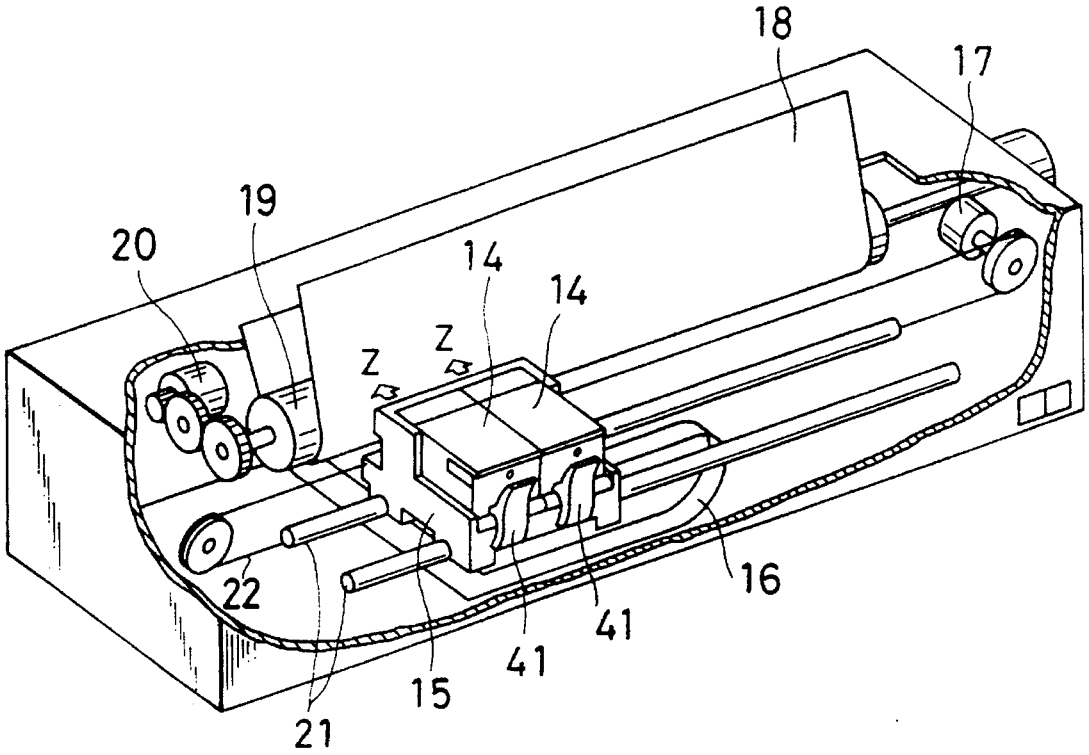
FIG. 9 is a schematic perspective view illustrating the general construction of an ink-jet recording apparatus in accordance with the present invention.

Instead of the heater board 27 described above with reference to FIG. 1, the heater board with the above-described construction is used to fabricate a recording head, and by using such the recording head, an ink-jet recording apparatus is constructed shown in FIG. 9.

Referring to FIG. 9, reference numeral 14 denotes a head cartridge which is a unitary construction comprising the recording head fabricated by using the heater board 1 in accordance with the present invention and an ink supply source or tank. The head cartridge 14 is securely mounted on a carriage 15 by a retaining member 41 and is reciprocally movable on shafts 21 in the lengthwise direction. The ink discharged from the recording head flies to reach the surface of a recording medium 18 which is spaced apart from the recording head by a very small distance and whose recording surface is maintained by a platen 19 so that a pattern is recorded on the recording medium 18.

The discharge signals are transmitted from a suitable data supply source depending upon a pattern to be recorded through a cable 16 and terminals of the driving unit 10 to which is connected the cable 16. The outputs representative of the detected temperatures are delivered from the recording head to a control unit to be described, below through the terminals of the temperature sensors 2*a* and 2*b*, and through the cable 16. In response to the outputs, the temperature control signal are transmitted from the control unit through the cable 16 to terminals of the warming heaters 8*a* and 8*b*.

For instance, depending of colors to be used in recording, one or more (two in FIG. 9) head cartridges are installed on the carriage. Referring still FIG. 9, reference numeral 17 indicates a carriage motor for reciprocally moving the carriage 15 along the shafts 21; 22, an endless wire for transmitting the driving force produced by the carriage motor 17 to the carriage 15; and 20, a feed motor connected to a platen roller 19 so as to transport the recording medium 18.

Figure 10:
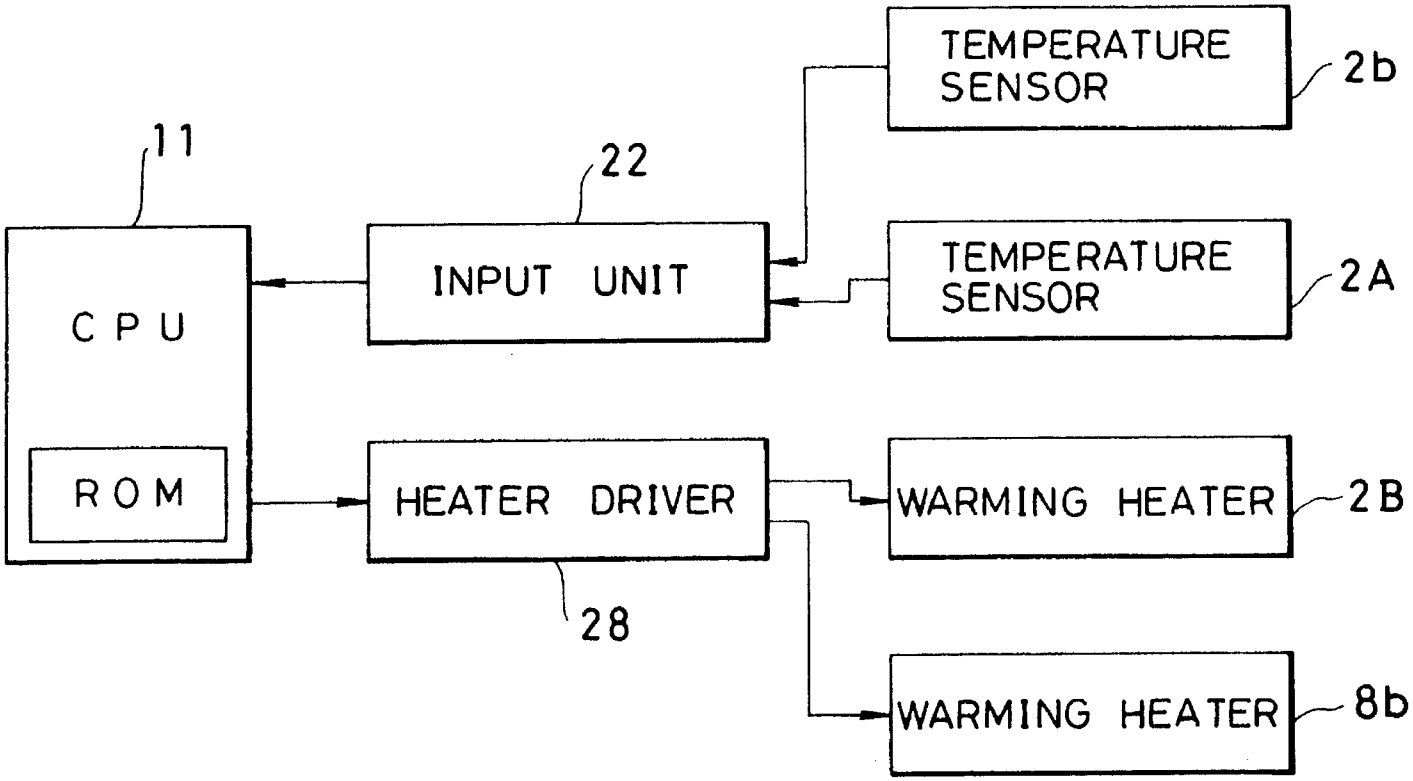
FIG. 10 is a block diagram illustrating a temperature control system thereof.

FIG. 10 illustrates one of the examples of the temperature control systems which operates in response to the outputs from the temperature sensors 2*a* and 2*b*, and controls the heaters 8*a* and 8 described above with reference to FIG. 2. The components connected to the temperature sensors 2*a* and 2*b* and the warming heaters 8*a* and 8*b* may be disposed on a control board of the recording apparatus and connected to the terminals (not shown) of the heater board 1 through the cable 16.

Reference numeral 11 represents a CPU in the form of a microcomputer in order to execute a control sequence to be described hereinafter with reference to FIG. 11 and includes a ROM storing therein predetermined data such as a program for carrying out the control sequence. The CPU 11 can be provided in order to independently execute the temperature control of the recording head in accordance with the present invention. Alternately, it can be also used as a main control unit not only in the apparatus shown in FIG. 9 but also in apparatus as to be described hereinafter with reference to FIG. 13 or 14.

Reference numeral 22 denotes an input unit which energizes selectively the temperature sensors 2*a* and 2*b* under the control of CPU 11 so as to derive therefrom the outputs representative of the detected temperatures and convert the outputs thus obtained into the signal which CUP 11 can process; and 28, a heater driver for selectively energizing the warming heaters 8*a* and 8*b*.

The heater board 1 has a large number of heat generating elements so that it is made into close contact with a plate made of aluminum or the like. But there is the differences in temperature among the discharging heaters 5, other portions (for instance, the positions of the temperature sensors 2*a* and 2*b*) and the aluminum plate. In addition, the temperature changes of these components and portions are different in time and a time delay occurs on the aluminum plate during the transient period of the temperature rise curve.

So far, from the standpoint of the space, it is difficult to dispose the temperature sensors on the heater board so that they are disposed on the aluminum plate in many cases. However, the temperature difference between the portions in the vicinity of the discharging heaters 5 which influence the ink discharging characteristics and the aluminum plate so that the temperature detection with a high degree of accuracy is difficult.

On the other hand, according to the present invention, the temperature sensors 2*a* and 2*b* are disposed on the heater board 1 as shown in FIG. 2, 6 or 7 so that the temperature detection with a higher degree of accuracy becomes possible.

Figure 11:
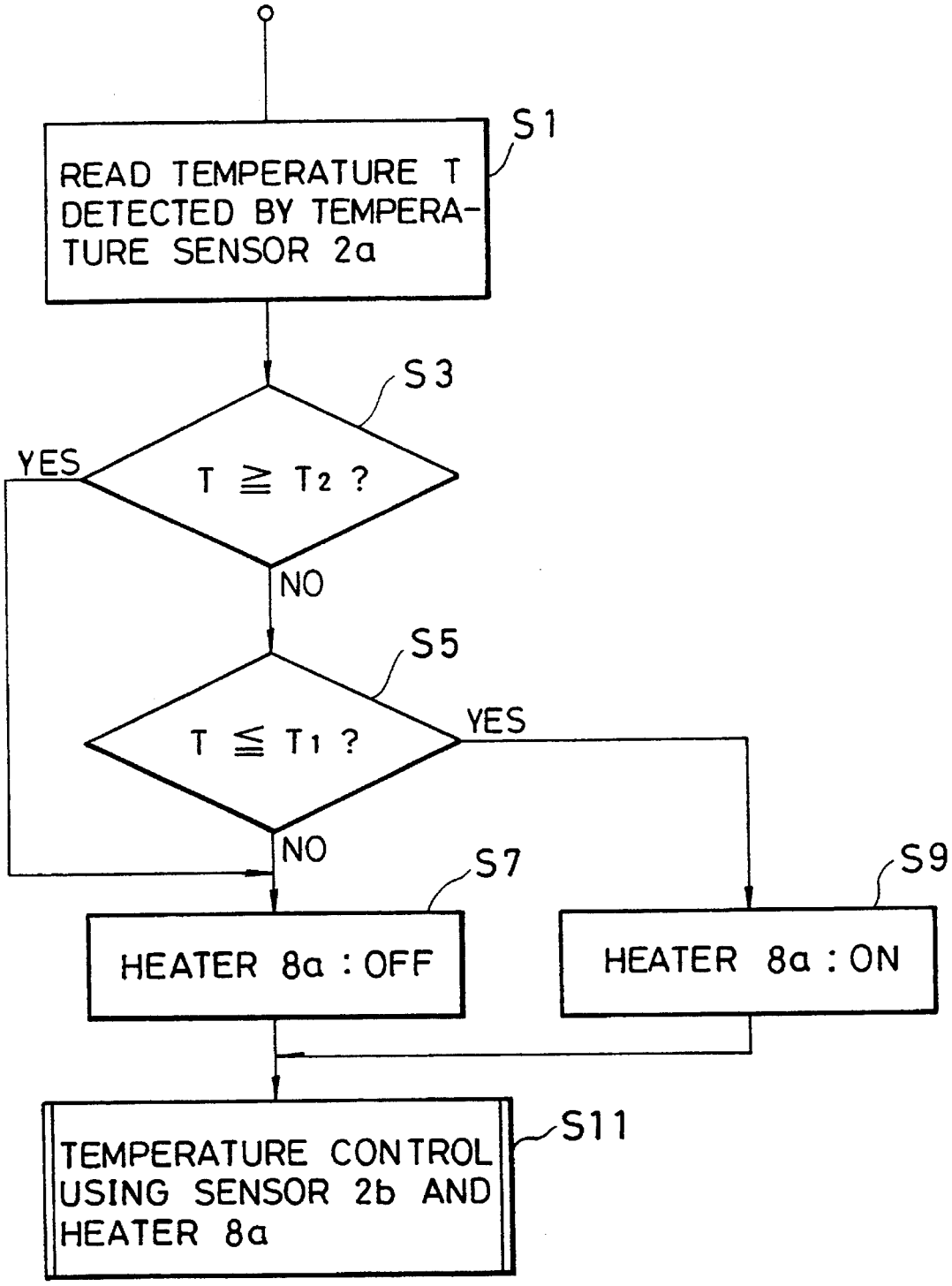
FIG. 11 is a flowchart used to explain the temperature control sequence thereof.

FIG. 11 illustrates one example of the temperature control process in accordance with the present invention. In this embodiment, the warming heaters 8*a* and 8*b* are individually and independently controlled in response to the outputs from the temperature sensors 2*a* and 2*b* respectively, in such a way that the temperatures at the positions at which the temperature sensors 2*a* and 2*b* are disposed can be maintained within the range from $T_1$–$T_2$ ($T_1<T_2$), so that the discharging heater array 3 can be maintained within the optimum ink discharging temperature; that is, within the control range shown in FIG. 12.

Figure 12:
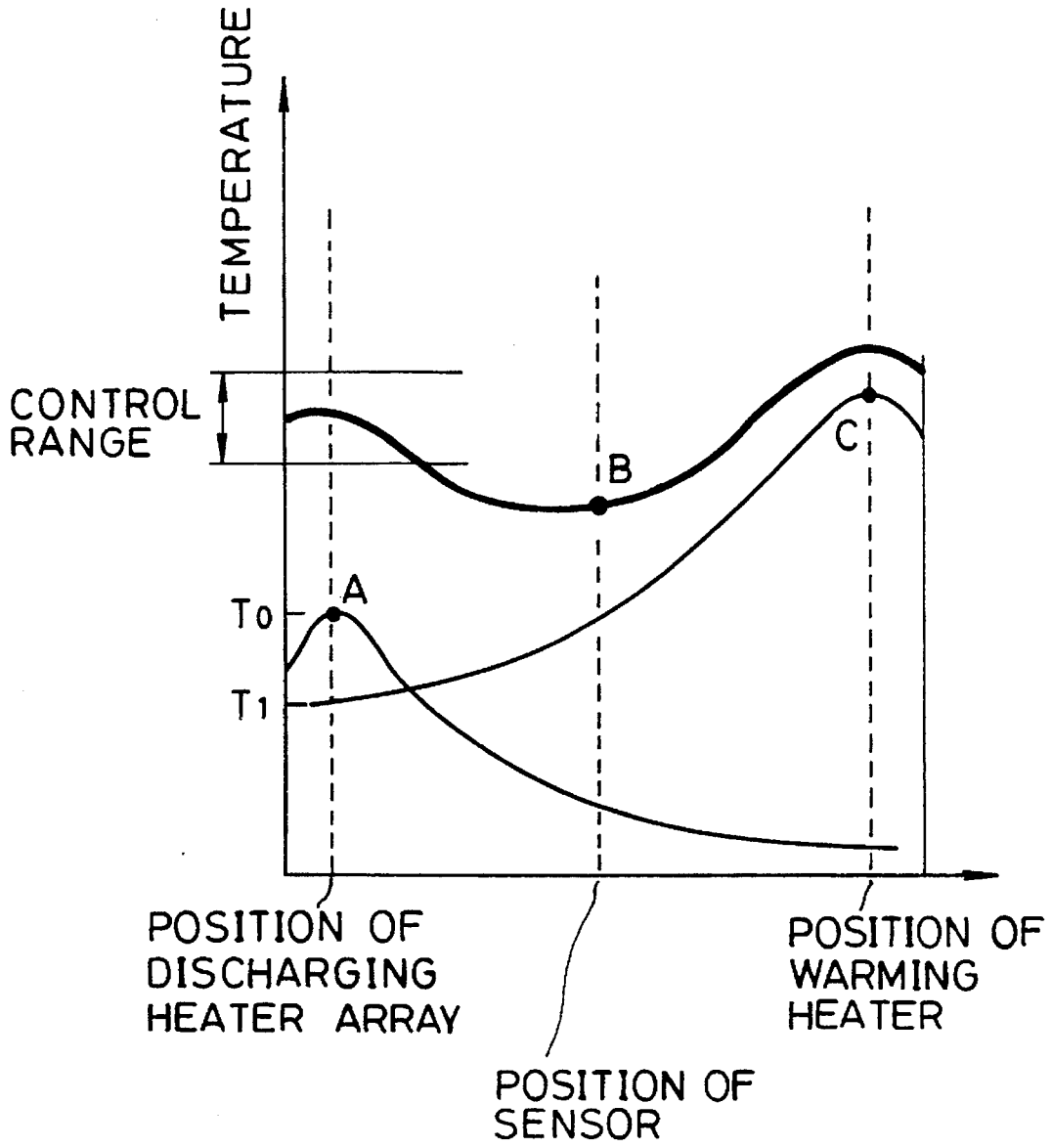
FIG. 12 is a diagram used to explain the temperature control mode thereof.

FIG. 12 illustrates the temperature distributions of a portion between the discharging heater array 3 and the warming heater 8*a* or 8*b* in the case of the recording mode. The temperature is so controlled that the discharging heater array 3 can be maintained within predetermined temperature range.

The ON/OFF operations of the warming heaters 8*a* and 8*b* are so controlled that the temperatures of the sensors which are dependent upon the temperature A which in turn is dependent on the heat produced by the discharging heaters, can be maintained within the temperature range ($T_1$–$T_2$). In this case, the heat produced by the discharging heaters can be detected in accordance with the driving outputs given to them.

The control sequence shown in FIG. 11 can be started at a suitable timing. When the control sequence is started, the output from the sensor 2*a* is detected in Step S1 and the detection whether the detected temperature T is higher than or equals to the temperature $T_2$ or not in Step S3. When the result of the detection made in Step S3 is No, the control process proceeds to the Step S5 in which whether the temperature T detected by the temperature sensor 2*a* is lower than or equals to the temperature $T_1$.

When the result of the detection made in Step S5 is No or when the result of the detection made in Step S3 is YES, the heater 8*a* is deenergized in Step S7. When the result of the detection made in Step S5 is YES, the heater 8*a* is energized in the Step S9.

Thereafter the temperature control process proceeds to Step S11 in which in response to the output from the temperature sensor 2*b*, the ON/OFF operation of the heater 8*b* is carried out in a manner substantially similar to steps from S1 to S9 described above.

FURTHER DESCRIPTION

The present invention achieves distinct effect when applied to a recording head or a recording apparatus which has means for generating thermal energy such as electrothermal transducers or laser light, and which causes changes in the ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording system, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy correspondent to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the thermoelectric transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, as an output device of a facsimile apparatus having a transmission and receiving function, and as an output device of an optical disc apparatus for recording and/or reproducing information into and/or from an optical disc. These apparatus requires means for outputting processed information in the form of hand copy.

Figure 13:
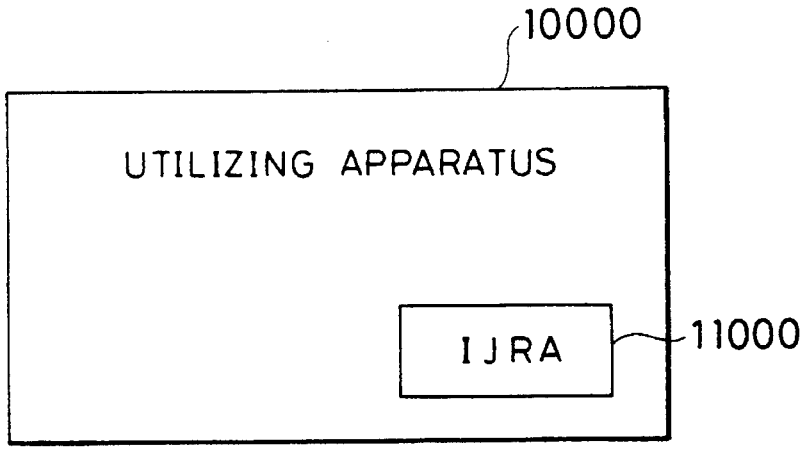
FIG. 13 is a block diagram of a utilizing apparatus which uses an ink-jet recording apparatus in accordance with the present invention as an information output means.

FIG. 13 schematically illustrates one embodiment of a utilizing apparatus in accordance with the present invention to which the ink jet recording system shown in FIG. 9 is equipped as an output means for outputting processed information.

In FIG. 13, reference numeral 10000 schematically denotes a utilizing apparatus which can be a work station, a personal or host computer, a word processor, a copying machine, a facsimile machine or an optical disc apparatus. Reference numeral 11000 denotes the ink jet recording apparatus (IJRA) shown in FIG. 9. The ink jet recording apparatus (IJRA) 11000 receives processed information form the utilizing apparatus 10000 and provides a print output as hand copy under the control of the utilizing apparatus 10000.

Figure 14:
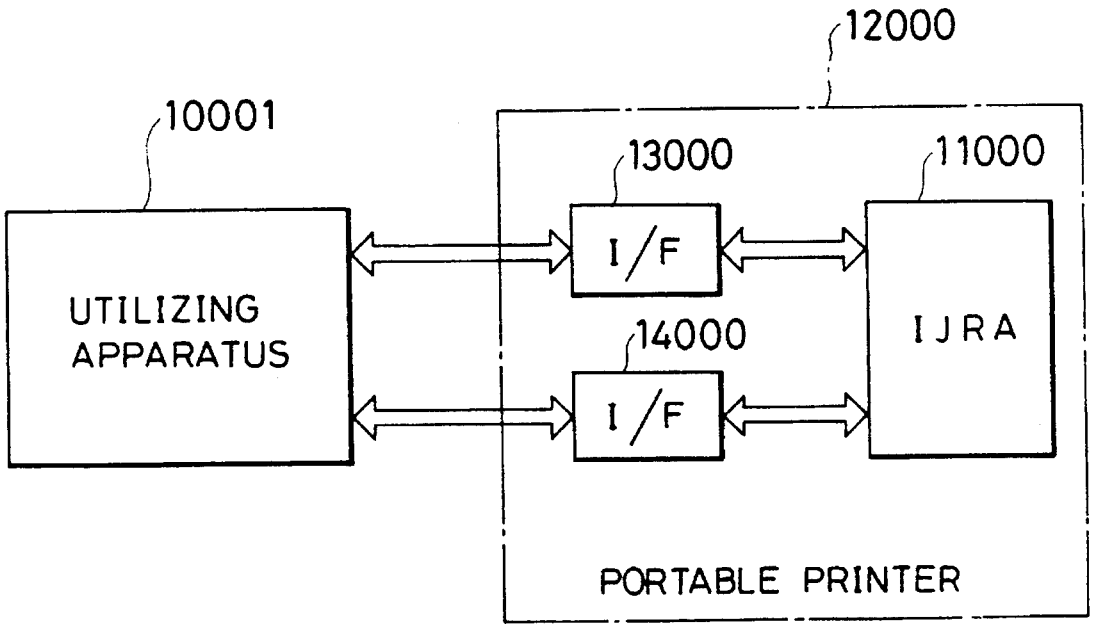
FIG. 14 is a block diagram illustrating a portable printer incorporating an ink-jet recording apparatus in accordance with the present invention and an apparatus which uses the portable printer as an information output means.

FIG. 14 schematically illustrates another embodiment of a portable printer in accordance with the present invention to which a utilizing apparatus such as a work station, a personal or host computer, a word processor, a copying machine, a facsimile machine or an optical disc apparatus can be coupled.

In FIG. 14, reference numeral 10001 schematically denotes such a utilizing apparatus. Reference numeral 12000 schematically denotes a portable printer having the ink jet recording apparatus (IJRA) 11000 shown in FIG. 9 is incorporated thereinto and interface circuits 13000 and 14000 receiving information processed by the utilizing apparatus 11001 and various controlling data for controlling the ink jet recording apparatus 11000, including head shake and interruption control from the utilizing apparatus 11001. Such control per se is realized by conventional printer control technology.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

As described above, accordingly to the present invention, the temperature sensors are disposed at suitable positions, respectively, from the standpoint of the heat transmission only from the discharging heaters but also the warming heaters so that the temperature control with a high degree of accuracy and response can be carried out in the stabilized manner.

We claim:

1. An ink-jet recording head having a plurality of ink discharging orifices, and having, positioned on a same substrate, a plurality of heat generating elements for generating thermal energy used for discharging ink from said ink discharging orifices, a temperature sensor element for detecting a temperature of said substrate and a heating element for applying heat to said substrate, characterized in that said temperature sensor element is disposed at a position where a time required for the influence due to a temperature change, when only a predetermined heat generating element is energized, to become exertive on said position is substantially equal or equal to a time required for the influence due to a temperature change, when only said heating element is energized, to become exertive on said position, and wherein said predetermined heat generating element is selected from an intermediate temperature portion of said plurality of generating elements.

2. An ink-jet recording head having a plurality of ink discharging orifices, and having, positioned on a same substrate, a plurality of heat generating elements for generating thermal energy used for discharging ink from said ink discharging orifices, a temperature sensor element for detecting a temperature of said substrate and a heating element for applying heat to said substrate, characterized in that said temperature sensor element is disposed at a position where a time required for the influence due to a temperature change, when only a predetermined heat generating element is energized, to become exertive on said position is substantially equal or equal to a time required for the influence due to a temperature change, when only said heating element is energized, to become exertive on said position, and wherein said predetermined heat generating element is selected from an high temperature portion of said plurality of heat generating elements.

3. An ink-jet recording head as claimed in claim 2, characterized in that said temperature sensor element is disposed within a circle drawn at said position as a center and with a radius of P×N/4, where N represents the number of heat generating elements in said high-temperature portion of said plurality of heat generating elements; and P denotes a pitch at in the array of said plurality of heat generating elements.

4. An ink-jet recording head having a plurality of ink discharging orifices, and having, positioned on a same substrate, a plurality of heat generating elements for generating thermal energy used for discharging ink from said ink discharging orifices, a temperature sensor element for detecting a temperature of said substrate and a heating element for applying heat to said substrate, characterized in that said temperature sensor element is disposed at a position where a time required for the influence due to a temperature change, when only a predetermined heat generating element is energized, to become exertive on said position is substantially equal or equal to a time required for the influence due to a temperature change, when only said heating element is energized, to become exertive on said position, and wherein said predetermined heat generating element is one of said plurality of heat generating elements which exhibits substantially an average temperature of said plurality of heat generating elements.

5. An ink-jet recording head as claimed in any of claims 1–4, characterized in that said position at which said temperature sensor element is disposed is spaced apart from said predetermined heat generating element and said heating element by the substantially same distance.

6. An ink-jet recording head as claimed in any of claims 1–4, characterized by having plurality of said temperature sensor elements equal in number to a plurality of said heating elements.

7. An ink-jet recording head as claimed in any of claims 1–4, further characterized by having one or more temperature sensor elements whose number is less than a plurality of said heating elements.

8. An ink-jet recording head as claimed in any of claims 1–4, characterized in that said temperature sensor element is a diode sensor.

9. An ink-jet recording head having a plurality of ink discharging orifices, and having, positioned on a same substrate, a plurality of heat generating elements for generating thermal energy used for discharging ink from said orifices, temperature sensor element for detecting a temperature of said substrate and a heating element for applying heat to said substrate, characterized in that said temperature sensor element is disposed at a position which is spaced apart from a predetermined heat generating element and said heating element by the substantially same or same distance, and wherein said predetermined heat generating element is selected from an intermediate temperature portion of said plurality of heat generating element.

10. An ink-jet recording head having a plurality of ink discharging orifices, and having, positioned on a same substrate, a plurality of heat generating elements for generating thermal energy used for discharging ink from said orifices, temperature sensor element for detecting a temperature of said substrate and a heating element for applying heat to said substrate, characterized in that said temperature sensor element is disposed at a position which is spaced apart from a predetermined heat generating element and said heating element by the substantially same or same distance, wherein said predetermined heat generating element is selected from a high temperature portion of said plurality of heat generating elements.

11. An ink-jet recording head having a plurality of ink discharging orifices, and having, positioned on a same substrate, a plurality of heat generating elements for generating thermal energy used for discharging ink from said orifices, temperature sensor element for detecting a temperature of said substrate and a heating element for applying heat to said substrate, characterized in that said temperature sensor element is disposed at a position which is spaced apart from a predetermined heat generating element and said heating element by the substantially same or same distance, and wherein said predetermined heat generating element is one of said plurality of heat generating elements which exhibits substantially an average temperature of said plurality of heat generating elements.

12. An ink-jet recording head as claimed in any of claims 9–11, characterized by having a plurality of said temperature sensor elements equal in number to a plurality of said heating elements.

13. An ink-jet recording head as claimed in any of claims 9–11, characterized by having a plurality of said temperature sensor elements whose number is less than a plurality of said heating elements.

14. A board for an ink-jet recording head having a plurality of ink discharge orifices, and having, positioned on a same substrate, a plurality of heat generating elements for generating thermal energy used for discharging ink from ink discharging orifices, temperature sensor element for detecting a temperature of said substrate and heating element for applying heat to said substrate, characterized in that said temperature sensor element is disposed at the position where a time required for the influence due to a temperature change, when only a predetermined heat generating element is energized, to become exertive on said position is substantially equal or equal to a time required for the influence due to a temperature change, when only said heating elements is energized, to become exertive on said position, and wherein said predetermined heat generating element is selected from an intermediate temperature portion of said plurality of heat generating elements.

15. A board for an ink-jet recording head having, positioned on a same substrate, a plurality of heat generating elements for generating thermal energy used for discharging ink from ink discharging orifices, temperature sensor element for detecting a temperature of said substrate and heating element for applying heat to said substrate, characterized in that said temperature sensor element is disposed at the position where a time required for the influence due to a temperature change, when only a predetermined heat generating element is energized, to become exertive on said position is substantially equal or equal to a time required for the influence due to a temperature change, when only said heating elements is energized, to become exertive on said position, and wherein said predetermined heat generating element is selected a high temperature portion of said plurality of heat generating elements.

16. A board for an ink-jet recording head having, positioned on a same substrate, a plurality of heat generating elements for generating thermal energy used for discharging ink from ink discharging orifices, temperature sensor element for detecting a temperature of said substrate and heating element for applying heat to said substrate, characterized in that said temperature sensor element is disposed at the position where a time required for the influence due to a temperature change, when only a predetermined heat generating element is energized, to become exertive on said position is substantially equal or equal to a time required for the influence due to a temperature change, when only said heating elements is energized, to become exertive on said position, and wherein said temperature sensor element is disposed within a circle drawn about said position at a center with a radius of P×N/4, where N represents the number of said heat generating elements in said high temperature portion of said plurality of heat generating elements; and P denotes a pitch in the array of said plurality of said heat generating elements.

17. A board for an ink-jet recording head having, positioned on a same substrate, a plurality of heat generating elements for generating thermal energy used for discharging ink from ink discharging orifices, temperature sensor element for detecting a temperature of said substrate and heating element for applying heat to said substrate, characterized in that said temperature sensor element is disposed at the position where a time required for the influence due to a temperature change, when only a predetermined heat generating element is energized, to become exertive on said position is substantially equal or equal to a time required for the influence due to a temperature change, when only said heating elements is energized, to become exertive on said position, and wherein said predetermined heat generating element is one of said plurality of heat generating elements which exhibits substantially an average temperature of said plurality of heat generating elements.

18. A board for an ink-jet recording head as claimed in any of claims 14–17, characterized in that said position at which said temperature sensor element is disposed is spaced apart from said predetermined heat generating element and said heating element by the substantially same distance.

19. An ink-jet recording apparatus with an ink-jet recording head, said head having a plurality of ink discharging orifices, and having, positioned on a same substrate, a plurality of heat generating elements for generating thermal energy used for discharging ink from said ink discharging orifices, temperature sensor element for detecting a temperature of said substrate and a heating element for applying heat to said substrate, characterized in that said temperature sensor element is disposed at a position where a time required for the influence due to a temperature change, when only a predetermined heat generating element of said recording head is energized to become exertive on said position is substantially equal or equal to a time required for the influence due to a temperature change, when only said heating element is energized, to become exertive on said position, and wherein said predetermined heat generating element is selected from an-intermediate temperature portion of said plurality of heat generating elements.

20. An ink-jet recording apparatus with an ink-jet recording head, said head having a plurality ink discharging orifices, and having, positioned on a same substrate, a plurality of heat generating elements for generating thermal energy used for discharging ink from said ink discharging orifices, temperature sensor element for detecting a temperature of said substrate and a heating element for applying heat to said substrate, characterized in that said temperature sensor element is disposed at a position where a time required for the influence due to a temperature change, when only a predetermined heat generating element of said recording head is energized to become exertive on said position is substantially equal or equal to a time required for the influence due to a temperature change, when only said heating element is energized, to become exertive on said position, and wherein said predetermined heat generating element is selected form a high temperature portion of said heat generating elements.

21. An ink-jet recording apparatus with an ink-jet recording head, said head having a plurality of ink discharging orifices, and having, positioned on a same substrate, a plurality of heat generating elements for generating thermal energy used for discharging ink from said ink discharging orifices, temperature sensor element for detecting a temperature of said substrate and a heating element for applying heat to said substrate, characterized in that said temperature sensor element is disposed at a position where a time required for the influence due to a temperature change, when only a predetermined heat generating element of said recording head is energized to become exertive on said position is substantially equal or equal to a time required for the influence due to a temperature change, when only said heating element is energized, to become exertive on said position, and wherein said temperature sensor element is disposed at a position within a circle drawn at said position as a center and with a radius of P×N/4, where N is the number of heat generating elements in said high temperature portion of said plurality of heat generating elements, and P denotes a pitch in the array of said plurality of said heat generating elements.

22. An ink-jet recording apparatus with an ink-jet recording head, said head having a plurality of ink discharging orifices, and having, positioned on a same substrate, a plurality of heat generating elements for generating thermal energy used for discharging ink from said ink discharging orifices, temperature sensor element for detecting a temperature of said substrate and a heating element for applying heat to said substrate, characterized in that said temperature sensor element is disposed at a position where a time required for the influence due to a temperature change, when only a predetermined heat generating element of said recording head is energized to become exertive on said position is substantially equal or equal to a time required for the influence due to a temperature change, when only said heating element is energized, to become exertive on said position, and wherein said predetermined heat generating element is one of said plurality of heat generating elements which exhibits substantially an average temperature of said plurality of heat generating elements.

23. An ink-jet recording apparatus as claimed in any of claims 19–22, characterized in that said position at which said temperature sensor element is disposed is spaced apart from said predetermined heat generating element and said heating element by the substantially same distance.

* * * * *

UNITED STATES PATENT AND TRADEMARK OFFICE

CERTIFICATE OF CORRECTION

PATENT NO. : 5,467,113

DATED : November 14, 1995

INVENTOR(S) : HIROYUKI ISHINAGA ET AL.

It is certified that error appears in the above-indentified patent and that said Letters Patent is hereby corrected as shown below:

On the title page item [56],

REFERENCES CITED

Foreign Patent Documents,
"195056" should read --1-95056--.

AT [22] PCT FILED

Insert, --[22] PCT Filed: Feb. 26, 1991--.

AT [86] PCT NO.

Insert, --[86] PCT No.: PCT/JP/00251
§ 371 Date: Dec. 12, 1991
§ 102(e) Date: Dec. 12, 1991--.

AT [87] PCT PUB. NO.

Insert, --[87] PCT Pub. No.: WO91/12966
PCT Pub. Date: Sep. 5, 1991--.

COLUMN 1

Line 37, "costs." should read --cost.--.

UNITED STATES PATENT AND TRADEMARK OFFICE

CERTIFICATE OF CORRECTION

PATENT NO. : 5,467,113

DATED : November 14, 1995

INVENTOR(S) : HIROYUKI ISHINAGA ET AL.

It is certified that error appears in the above-indentified patent and that said Letters Patent is hereby corrected as shown below:

COLUMN 2

Line 25, "are" should read --is--.
Line 58, "such the" should read --such--.
Line 60, "heaters the" should read --heaters of the--.

COLUMN 3

Line 13, "for" should be deleted.

COLUMN 4

Line 17, "elements" should read --element--.
Line 35, "The" should read --the--.
Line 43, "an" should read --a--.
Line 57, "at" should read --of--.

COLUMN 7

Line 8, "formed" should read --be formed--.
Line 19, "sensor 8a or 8b," should read --sensor 2a or 2b,--.
Line 53, "FIG. 4C" should read --FIG. 4C,--.

UNITED STATES PATENT AND TRADEMARK OFFICE

CERTIFICATE OF CORRECTION

PATENT NO. : 5,467,113

DATED : November 14, 1995

INVENTOR(S) : HIROYUKI ISHINAGA ET AL.

It is certified that error appears in the above-indentified patent and that said Letters Patent is hereby corrected as shown below:

COLUMN 8

Line 20, "gradient c" should read --gradient C--.
Line 57, "less" should read --fewer--.

COLUMN 9

Line 8, "represent" should read --represents--.
Line 10, "heater (or 8a)." should read --heater 8b (or 8a).--.
Line 14, "on the" should be deleted.
Line 21, "is occur" should read --occurs--.
Line 43, "on hand" should read --one hand-- and "heater" (second occurrence) should read --heaters--.
Line 48, "deviated" should read --be deviated--.

COLUMN 10

Line 6, "at" should read --as--.

COLUMN 11

Line 18, "or" should read --or the--.
Lne 31, "$Pn_b$" should read --$Pn_b$,--.

UNITED STATES PATENT AND TRADEMARK OFFICE

CERTIFICATE OF CORRECTION

PATENT NO. : 5,467,113

DATED : November 14, 1995

INVENTOR(S) : HIROYUKI ISHINAGA ET AL.

It is certified that error appears in the above-indentified patent and that said Letters Patent is hereby corrected as shown below:

COLUMN 12

Line 53, "wires as" should read --wires. As--.
Line 56, "numeral" should read --numeral 10--.

COLUMN 13

Line 19, "signal" should read --signals--.
Line 21, "of" should read --on--.
Line 23, "still" should read --still to--.
Line 48, "apparatus" should read --the apparatus--.
Line 54, "CUP 11" should read --CPU 11--.

COLUMN 15

Line 44, "consists" should read --consist--.

COLUMN 16

Line 46, "apparatus requires" should read --apparatuses require--.

COLUMN 17

Line 6, "is" should be deleted.
Line 9, "11001" shoud read --10001--.
Line 11, "11001" shoud read --10001--.
Line 65, "an" should read --a--.

UNITED STATES PATENT AND TRADEMARK OFFICE

CERTIFICATE OF CORRECTION

PATENT NO. : 5,467,113

DATED : November 14, 1995

INVENTOR(S) : HIROYUKI ISHINAGA ET AL.

It is certified that error appears in the above-indentified patent and that said Letters Patent is hereby corrected as shown below:

COLUMN 18

Line 6, "at" should be deleted.
Line 28, "1-4," should read --1, 2 or 4,--.
Line 33, "1-4," should read --1, 2 or 4,--.
Line 37, "1-4," should read --1, 2 or 4,--.
Line 41, "1-4," should read --1, 2 or 4,--.
Line 55, "element." should read --elements.--.

COLUMN 19

Line 36, "elements" should read --element--.
Line 55, "selected" should read --selected from--.

UNITED STATES PATENT AND TRADEMARK OFFICE

CERTIFICATE OF CORRECTION

PATENT NO. : 5,467,113

DATED : November 14, 1995

INVENTOR(S) : HIROYUKI ISHINAGA ET AL.

It is certified that error appears in the above-indentified patent and that said Letters Patent is hereby corrected as shown below:

COLUMN 20

Line 8, "said" (second occurrence) should be deleted.
Line 48, "an-intermediate" should read --an intermediate--.
Line 51, "plurality" should read --plurality of--.
Line 66, "form" should read --from--.

Signed and Sealed this

Twenty-fifth Day of June, 1996

Bruce Lehman

*Attest:*

BRUCE LEHMAN

*Attesting Officer*

*Commissioner of Patents and Trademarks*